US009885259B2

(12) United States Patent
Mitsuhashi et al.

(10) Patent No.: US 9,885,259 B2
(45) Date of Patent: Feb. 6, 2018

(54) LOCK DETERMINATION DEVICE FOR VARIABLE VALVE TIMING MECHANISM AND LOCK DETERMINATION METHOD FOR VARIABLE VALVE TIMING MECHANISM

(71) Applicant: NISSAN MOTOR CO., LTD., Yokohama-shi, Kanagawa (JP)

(72) Inventors: Hideo Mitsuhashi, Kanagawa (JP); Kenji Ariga, Kanagawa (JP); Takahiro Anada, Kanagawa (JP); Ken Shiozawa, Kanagawa (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 89 days.

(21) Appl. No.: 14/895,584

(22) PCT Filed: Mar. 28, 2014

(86) PCT No.: PCT/JP2014/059204
§ 371 (c)(1),
(2) Date: Dec. 3, 2015

(87) PCT Pub. No.: WO2014/196250
PCT Pub. Date: Dec. 11, 2014

(65) Prior Publication Data

US 2016/0130987 A1 May 12, 2016

(30) Foreign Application Priority Data

Jun. 4, 2013 (JP) ..... 2013-117786

(51) Int. Cl.
*F01L 1/34* (2006.01)
*F01L 1/344* (2006.01)
*F02D 41/04* (2006.01)

(52) U.S. Cl.
CPC ..... *F01L 1/34* (2013.01); *F01L 1/3442* (2013.01); *F02D 41/042* (2013.01);
(Continued)

(58) Field of Classification Search
CPC . F01L 1/34; F01L 1/3442; F01L 2001/34463; F01L 2820/041; F02D 41/042
(Continued)

(56) References Cited

U.S. PATENT DOCUMENTS 7,987,827 B2 * 8/2011 Fujiyoshi ..... F01L 1/022 123/90.12
2010/0269772 A1 10/2010 Takemura et al.

FOREIGN PATENT DOCUMENTS

EP 2157291 A1 2/2010
EP 2636858 A1 9/2013
(Continued)

*Primary Examiner* — Ching Chang
(74) *Attorney, Agent, or Firm* — Drinker Biddle & Reath LLP

(57) ABSTRACT

A lock determination device for variable valve timing mechanism includes means for detecting an operating position of a variable valve timing mechanism having a function of locking a valve timing of an internal combustion engine in an intermediate position between a most retarded position where the valve timing is most retarded and a most advanced position where the valve timing is most advanced in stopping operation of the internal combustion engine, means for starting a timer when the operating position of the variable valve timing mechanism enters an intermediate region, the intermediate region being a predetermined region including the intermediate position, means for determining whether or not the operating position of the variable valve timing mechanism is in a determination holding region wider on a retardation side than the intermediate region after the timer is started, means for incrementing a value of the timer if the operating position of the variable valve timing mechanism is
(Continued)

in the determination holding region, and means for determining that the operating position of the variable valve timing mechanism has been locked in the intermediate position when the value of the timer reaches a predetermined value.

6 Claims, 4 Drawing Sheets

(52) U.S. Cl.
CPC . *F01L 2001/34463* (2013.01); *F01L 2800/03* (2013.01); *F01L 2820/041* (2013.01)

(58) Field of Classification Search
USPC ..... 123/90.15, 90.17
See application file for complete search history.

(56) References Cited

FOREIGN PATENT DOCUMENTS

| | | | |
|---|---|---|---|
| JP | 2008-291852 | A | 12/2008 |
| JP | 2011-179418 | A | 9/2011 |
| WO | WO 2013/021749 | A1 | 2/2013 |

* cited by examiner

LOCK DETERMINATION DEVICE FOR VARIABLE VALVE TIMING MECHANISM AND LOCK DETERMINATION METHOD FOR VARIABLE VALVE TIMING MECHANISM

TECHNICAL FIELD

This invention relates to a control of a variable valve timing mechanism executed when operation of an internal combustion engine is stopped.

BACKGROUND ART

JP2008-291852A discloses a first variable valve timing mechanism for changing a lift amount of an intake valve and a second valve timing mechanism for changing a center angle of a lift of the intake valve as variable valve timing mechanisms for changing a valve timing of an internal combustion engine. These two variable valve timing mechanisms correct one position according to another position when the internal combustion engine is started.

JP2011-179418A discloses a variable valve timing mechanism configured to change a valve timing of an internal combustion engine using a hydraulic pressure and including a locking mechanism for locking the valve timing in an intermediate timing.

SUMMARY OF INVENTION

In consideration of startability and exhaust emission of an internal combustion engine, it is desirable to start the internal combustion engine in a state where a valve timing is set at an intermediate timing. However, if the internal combustion engine is stopped, for example, with an operating position of a variable valve timing mechanism held at a most retarded position, the internal combustion engine is started at a most retarded timing when the internal combustion engine is started next.

In the case of changing the valve timing using the hydraulic pressure as in the variable valve timing mechanism described in JP2011-179418A in such a situation, it is difficult to obtain a hydraulic pressure sufficient to change the valve timing during or immediately after the start of the internal combustion engine. Thus, the valve timing cannot be immediately set to the intermediate timing when the internal combustion engine is started.

Accordingly, it is preferable that the operating position of the variable valve timing mechanism is locked in an intermediate position, which is a position equivalent to the intermediate timing suitable for the start of the internal combustion engine, in advance in stopping the operation of the internal combustion engine. This is because the valve timing is maintained at the intermediate timing even when the hydraulic pressure is low if the operating position of the variable valve timing mechanism is locked in the intermediate position.

Further, in stopping the operation of the internal combustion engine, the operation of the internal combustion engine is desirably stopped after confirming whether or not the operating position of the variable valve timing mechanism has been reliably locked in the intermediate position to prevent a malfunction and grasp an operation environment of the internal combustion engine.

This invention was developed in view of the above and aims to provide a lock determination device for variable valve timing mechanism and a lock determination method for variable valve timing mechanism capable of precisely and quickly confirming that an operating position of a variable valve timing mechanism is locked in an intermediate position.

To achieve the above object, according to an aspect of the present invention, provided is a lock determination device for variable valve timing mechanism for a variable valve timing mechanism having a function of locking a valve timing of an internal combustion engine in an intermediate position between a most retarded position where the valve timing is most retarded and a most advanced position where the valve timing is most advanced in stopping operation of the internal combustion engine as a lock determination device for variable valve timing mechanism.

This lock determination device includes means for detecting an operating position of the variable valve timing mechanism, means for starting a timer when the operating position of the variable valve timing mechanism enters an intermediate region, the intermediate region being a predetermined region including the intermediate position, means for determining whether or not the operating position of the variable valve timing mechanism is in a determination holding region wider on a retardation side than the intermediate region after the timer is started, means for incrementing a value of the timer if the operating position of the variable valve timing mechanism is in the determination holding region, and means for determining that the operating position of the variable valve timing mechanism has been locked in the intermediate position when the value of the timer reaches a predetermined value.

DESCRIPTION OF EMBODIMENT

Hereinafter, an embodiment of the present invention is described with reference to the accompanying drawings.

Figure 1:
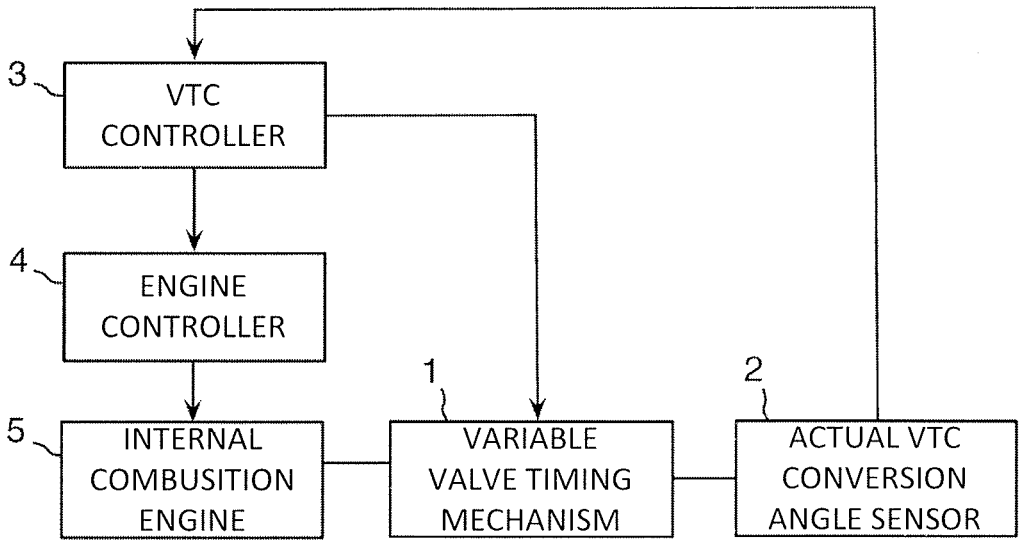
FIG. 1 is a block diagram showing the configuration of a lock determination device for variable valve timing mechanism according to an embodiment of this invention.

With reference to FIG. 1, an internal combustion engine 5 for vehicle includes a variable valve timing mechanism 1. The variable valve timing mechanism 1 is operated by a hydraulic pressure of an unillustrated hydraulic pump driven by the internal combustion engine 5. The variable valve timing mechanism 1 switches a valve timing of an intake valve of the internal combustion engine 5 to a most retarded timing, a most advanced timing and a predetermined intermediate timing between those timings. The intermediate timing is equivalent to a valve timing suitable for the start of the internal combustion engine 5.

The variable valve timing mechanism 1 includes a rotor, a housing provided to face the outer periphery of the rotor and a key configured to enter a key groove provided on the rotor in a radial direction from the housing as disclosed in JP2011-179418A. The rotor rotates according to the hydraulic pressure. The rotor rotates relative to the housing. The key is biased toward the key groove by a spring. When the rotor rotates relative to the housing and the valve timing of the internal combustion engine 5 reaches the intermediate timing, the key biased by the spring enters the key groove to lock the rotor in the housing. As a result, the operating position of the variable valve timing mechanism 1 is locked in an intermediate position. Unlocking is performed by causing the key to recede from the key groove against the spring by an unlocking hydraulic pressure. The unlocking hydraulic pressure acts in a direction opposite to the spring via an oil passage in the rotor.

An actual VTC conversion angle sensor 2 is attached to the variable valve timing mechanism 1. The actual VTC conversion angle sensor 2 detects a relative rotational position of the rotor with respect to the housing. A hydraulic pressure for displacing the rotor relative to the housing by relative rotation and a hydraulic pressure for causing the key to recede from the key groove are controlled by a VTC controller 3. Further, the start, stop and operation of the internal combustion engine 5 are controlled by an engine controller 4.

Each of the VTC controller 3 and the engine controller 4 is configured by a microcomputer and includes a central processing unit (CPU), a read-only memory (ROM), a random access memory (RAM) and an input/output interface (I/O interface). It is also possible to configure each of the VTC controller 3 and the engine controller 4 by a plurality of microcomputers. Alternatively, it is also possible to configure each of the VTC controller 3 and the engine controller 4 by a single microcomputer.

A signal of the relative rotational position detected by the actual VTC conversion angle sensor 2 is input to the VTC controller 3. The VTC controller 3 calculates an actual VTC conversion angle from the relative rotational position. The actual VTC conversion angle is a value equivalent to a crank angle and indicates an actual valve timing. The VTC controller 3 sets a target valve timing of the internal combustion engine 5 on the basis of operation conditions and feedback-controls the variable valve timing mechanism 1 so that the actual VTC conversion angle matches the target valve timing.

The VTC controller 3 controls supply of the hydraulic pressure to the variable valve timing mechanism 1 so that the actual VTC conversion angle, in other words, the operating position of the variable valve timing mechanism 1 reaches the intermediate position when an operation stop command for the internal combustion engine 5 is input. When the actual VTC conversion angle reaches the intermediate position, the operating position of the variable valve timing mechanism 1 is locked in the intermediate position by the entrance of the key into the key groove. Thereafter, the variable valve timing mechanism 1 keeps the operating position locked in the intermediate position until the unlocking hydraulic pressure is supplied.

The operation stop command for the internal combustion engine 5 is input, for example, by the switching of an ignition switch provided in a vehicle from ON to OFF. The VTC controller 3 performs the above processing for the variable valve timing mechanism 1 during a period from the operation stop command for the internal combustion engine 5 to the operation stop of the internal combustion engine 5. As a result, the internal combustion engine 5 can be restarted in a state where the valve timing is held at the intermediate timing.

Intermediate locking of locking the operating position of the variable valve timing mechanism 1 in the intermediate position is automatically performed in the aforementioned manner. However, to hold the valve timing at the intermediate timing at the restart of the internal combustion engine 5, it is desirable to determine whether or not the operating position of the variable valve timing mechanism 1 has been reliably locked in the intermediate position before the operation of the internal combustion engine 5 is stopped. This is because, depending on the structure of the variable valve timing mechanism 1, it takes time for an operation of displacing the operating position of the variable valve timing mechanism 1 to the intermediate position and an operation of locking the operating position in the intermediate position. Thus, it is also conceivable that the operation of the internal combustion engine 5 stops before the locking operation is completed.

Accordingly, the VTC controller 3 determines whether or not the operating position of the variable valve timing mechanism 1 has been actually locked in the intermediate position after performing the processing of locking the operating position of the variable valve timing mechanism 1 in the intermediate position as described above in response to the operation stop command for the internal combustion engine 5. By utilizing a determination result for the restart of the internal combustion engine 5, the restart of the internal combustion engine 5 is made in a preferable environment.

A lock determination routine and an engine start sequence determination routine executed by the VTC controller 3 to realize the above control are described with reference to FIGS. 2 and 3. The VTC controller 3 executes the lock determination routine shown in FIG. 2 which is triggered by the input of the operation stop command for the internal combustion engine 5. Further, the VTC controller 3 executes the engine start sequence determination routine shown in FIG. 3 prior to the start of the internal combustion engine 5 by the engine controller 4 in response to a start command for the internal combustion engine 5.

Figure 2:
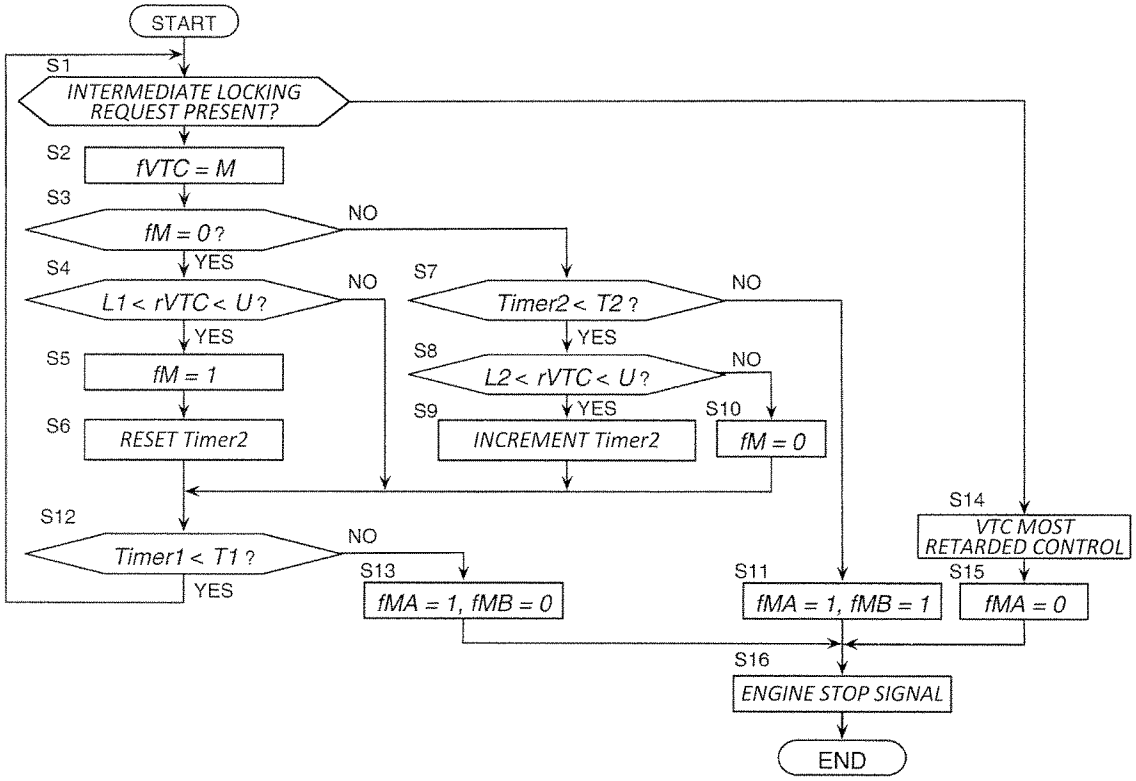
FIG. 2 is a flow chart showing a lock determination routine executed by a VTC controller.
Figure 3:
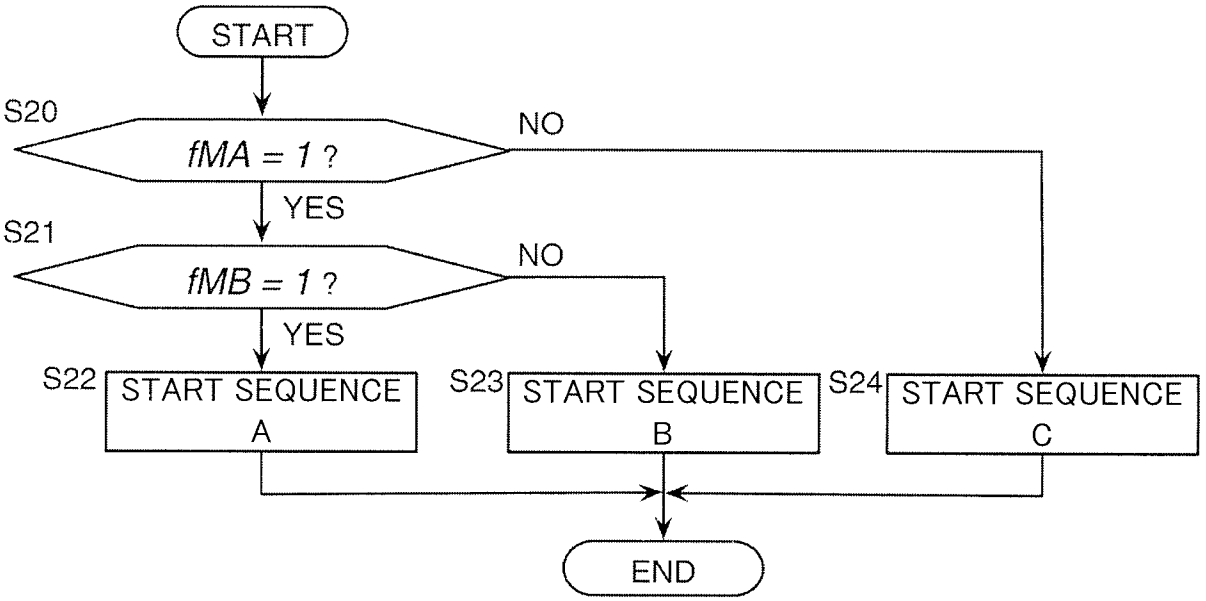
FIG. 3 is a flow chart showing an engine start sequence determination routine executed by the VTC controller.

With reference to FIG. 2, the VTC controller 3 determines the presence or absence of an intermediate locking request in Step S1 in response to the input of the operation stop command for the internal combustion engine 5. The stop of the internal combustion engine 5 is normally accompanied by the intermediate locking request, but may not be accompanied by the intermediate locking request only for a stop command for the internal combustion engine 5 under a special condition.

If the determination of Step S1 is negative, i.e. in response to the stop command under the special condition, the VTC controller 3 controls the operating position of the variable valve timing mechanism 1 to a most retarded position in Step S14. In Step S15, the VTC controller 3 sets an intermediate locking request flag fMA to zero meaning the absence of the intermediate locking request. Then, an engine stop signal is output to the engine controller 4 in Step S16. The engine controller 4 stops the operation of the internal combustion engine 5 upon receiving the input of the engine stop signal. After the processing of Step S16, the VTC controller 3 finishes the routine. It should be noted that, depending on the content of the special condition, it is also conceivable to control the operating position of the variable valve timing mechanism 1 to a most advanced position in Step S14.

If the determination of Step S1 is affirmative, i.e. in the presence of the intermediate locking request, the VTC controller 3 sets a target VTC conversion angle tVTC to an intermediate position M in Step S2. The VTC controller 3 feedback-controls the variable valve timing mechanism 1 so that an actual VTC conversion angle rVTC becomes equal to the target VTC conversion angle tVTC.

In subsequent Step S3, the VTC controller 3 determines whether or not an intermediate locking flag fM is zero. The intermediate locking flag fM is a flag indicating whether or not the actual VTC conversion angle rVTC is in an intermediate region. The intermediate region is a crank angle region including the intermediate position and is set in advance. That the intermediate locking flag fM is zero means that the actual VTC conversion angle rVTC is not in the intermediate region. An initial value of the intermediate locking flag fM is set at zero. Thus, the determination of Step S3 is affirmative in the first routine execution after the ignition switch is switched from ON to OFF.

If the determination of Step S3 is negative, the VTC controller 3 determines in Step S4 whether or not the actual VTC conversion angle rVTC is larger than a first lower limit value L1 and smaller than an upper limit value U. A region where the actual VTC conversion angle rVTC is larger than the first lower limit value L1 and smaller than the upper limit value U is the intermediate region. That is, the VTC controller 3 actually determines here whether or not the actual VTC conversion angle rVTC is in the intermediate region.

If the determination of Step S4 is affirmative, the VTC controller 3 sets the intermediate locking flag fM to 1 in Step S5. After the processing of Step S5, the VTC controller 3 resets a value of a second timer Timer2 to zero in Step S6. The second timer Timer2 is a timer for counting a duration of a state where the intermediate locking flag fM is set at 1. After the processing of Step S6, the VTC controller 3 performs the processing of Step S12.

If the determination of Step S3 is negative, the VTC controller 3 determines in Step S7 whether or not the value of the second timer Timer2 is smaller than a predetermined value T2. That the value of the second timer Timer2 is smaller than the predetermined value T2 means that the value of the second timer Timer2 has not reached the predetermined value T2. By continuing the state where the intermediate locking flag fM is set at 1 for a period equivalent to the predetermined value T2, the VTC controller 3 judges that the intermediate locking has been completed.

A case where the determination of Step S7 is affirmative is equivalent to a case where the intermediate locking has not been completed. In this case, the VTC controller 3 determines in Step S8 whether or not the actual VTC conversion angle rVTC is larger than a second lower limit value L2 and smaller than the upper limit value U. A region where the actual VTC conversion angle rVTC is larger than the second lower limit value L2 and smaller than the upper limit value U is a determination holding region. The second lower limit value L2 is set at a value smaller than the first lower limit value L1 indicating the lower limit of the intermediate region. In other words, the determination holding region is set wider on a retardation side than the intermediate region. A difference between the intermediate region and the determination holding region is described below.

When the variable valve timing mechanism 1 changes the valve timing in an advance direction from the most retarded position due to the operation stop command for the internal combustion engine 5 and the actual VTC conversion angle rVTC enters the intermediate region, the counting of the second timer Timer2 is started. On the other hand, once the actual VTC conversion angle rVTC enters the intermediate region, the VTC controller 3 judges that the intermediate locking is being performed and continues the counting of the second timer Timer2 unless the actual VTC conversion angle rVTC departs from the determination holding region wider on the retardation side than the intermediate region. That is, a difference between the first and second lower limit values L1, L2 is provided to provide a hysteresis between a determination as to whether or not the actual VTC conversion angle rVTC has entered the intermediate region and a determination as to whether or not the actual VTC conversion angle rVTC has departed from the intermediate region.

By this setting of the hysteresis, it is possible to precisely and quickly determine the completion of the locking of the operating position of the variable valve timing mechanism 1 in the intermediate position by preventing an erroneous determination due to an error of hardware. It should be noted that the hysteresis is set only on the side of the lower limit value of the actual VTC conversion angle rVTC, i.e. on the retardation side.

If the determination of Step S8 is affirmative, i.e. if the actual VTC conversion angle rVTC has not departed from the determination holding region, the VTC controller 3 increments the value of the second timer Timer2 in Step S9. After the processing of Step S9, the VTC controller 3 performs the processing of Step S12.

If the determination of Step S8 is negative, i.e. if the actual VTC conversion angle rVTC has departed from the determination holding region, the VTC controller 3 resets the intermediate locking flag fM to zero in Step S10. After the processing of Step S10, the VTC controller 3 performs the processing of Step S12.

If the determination of Step S7 is negative, i.e. if the value of the second timer Timer2 has reached the predetermined value T2, it means that the intermediate locking has been completed. In this case, the VTC controller 3 sets the intermediate locking request flag fMA to 1 and sets an intermediate locking completion flag fMB indicating the completion of the intermediate locking to 1 in Step S11. After the processing of Step S11, the VTC controller 3 outputs an engine stop signal to the engine controller 4 in Step S16 to finish the routine.

If the value of the second timer Timer2 is reset in Step S6, if the value of the second timer Timer2 is incremented in Step S9 and if the intermediate locking flag fM is reset to zero in Step S10, the VTC controller 3 determines in Step S12 whether or not a value of a first timer Timer1 is smaller than a predetermined value T1. The first timer Timer1 indicates an elapsed time after the input of the operation stop command for the internal combustion engine 5, i.e. an elapsed time after the switching of the ignition switch from ON to OFF. That the value of the first timer Timer1 is smaller than the predetermined value T1 means that the elapsed time from the switching of the ignition switch from ON to OFF has not reached a time equivalent to the predetermined value T1.

Here, the predetermined value T1 is set at a value larger than the predetermined value T2. The predetermined value T1 is set at such a value as not to give a sense of incongruity to a driver of the vehicle during a period from the switching of the ignition switch to OFF to the stop of the operation of the internal combustion engine 5.

If the determination of Step S12 is affirmative, i.e. if the elapsed time from the switching of the ignition switch to OFF has not reached the time equivalent to the predetermined value T1, the VTC controller 3 performs the processings in Step S1 and subsequent steps again. The VTC controller 3 performs the processing of Step S13 when the elapsed time from the switching of the ignition switch to OFF reaches the time equivalent to the predetermined value T1 by repeatedly performing the processings and the determination of Step S12 becomes negative. Step S13 is performed in a case where the elapsed time from the switching of the ignition switch to OFF reaches the time equivalent to the predetermined value T1 before the completion of the intermediate locking is confirmed.

In Step S13, the VTC controller 3 sets the intermediate locking request flag fMA to 1 and resets the intermediate locking completion flag fMB to zero. After the processing of Step S13, the VTC controller 3 outputs an engine stop signal to the engine controller 4 in Step S16 to finish the routine.

Next, the engine start sequence determination routine executed by the VTC controller 3 in response to the start command for the internal combustion engine 5 is described with reference to FIG. 3. Here, the start command for the internal combustion engine 5 means the switching of the ignition switch from OFF to ON.

In response to the start command for the internal combustion engine 5, the VTC controller 3 determines in Step S20 whether or not the intermediate locking request flag fMA is 1. If the intermediate locking request flag fMA is 1, the VTC controller 3 determines in Step S21 whether or not the intermediate locking completion flag fMB is 1. According to the result of the above determinations, the VTC controller 3 performs any one of start sequences A, B and C.

If the determination of Step S21 is affirmative, i.e. if both the intermediate locking request flag fMA and the intermediate locking completion flag fMB are 1, it means that the intermediate locking was requested and the intermediate locking was completed when the operation of the internal combustion engine 5 was stopped last time. In this case, the valve timing is held at the intermediate timing suitable for the start of the internal combustion engine 5 and the VTC controller 3 selects a sequence A meaning normal start in Step S22. After selecting the sequence A in Step S22, the VTC controller 3 outputs a start command signal to the engine controller 4 to finish the routine. The engine controller 4 having received the input of the start command signal starts the internal combustion engine 5 in accordance with the sequence A.

The sequence A is a sequence applied in a state where the valve timing is held at the intermediate timing suitable for start. The sequence A is a sequence for selecting start conditions such as a throttle opening, a fuel injection amount and an ignition timing for normal start. Since the valve timing is held at the intermediate timing, the internal combustion engine 5 is started in a state where starting performance and exhaust emission are kept in an optimal state under the sequence A.

If the determination of Step S21 is negative, i.e. if the intermediate locking request flag fMA is 1 and the intermediate locking completion flag fMB is zero, it means that the completion of the intermediate locking could not be confirmed despite the presence of the intermediate locking request when the operation of the internal combustion engine 5 was stopped last time. In this case, the VTC controller 3 selects a sequence B in Step S23 and outputs a start command signal to the engine controller 4 to finish the routine. The engine controller 4 having received the input of the start command signal starts the internal combustion engine 5 in accordance with the sequence B.

The sequence B is a sequence instructing the variable valve timing mechanism 1 to switch the operating position to the intermediate position simultaneously with the start of the cranking of the internal combustion engine 5. The start conditions such as the throttle opening, the fuel injection amount and the ignition timing are the same as in the sequence A. As a result, the valve timing is controlled to the intermediate timing in a shortest time from the start by the variable valve timing mechanism 1. It should be noted that even if the intermediate locking failed when the operation of the internal combustion engine 5 was stopped, the valve timing is not retarded beyond the position of the key. Thus, even in this case, there is no possibility of failing the start of the internal combustion engine 5. However, the deterioration of exhaust emission can be suppressed to a minimum level by controlling the valve timing to the intermediate timing in the shortest time from the start.

If the determination of Step S20 is negative i.e. the intermediate locking request flag fMA is zero, it means a case where the intermediate locking was not requested when the operation of the internal combustion engine 5 was stopped last time, i.e. the special condition described in the determination of Step 1. In this case, the VTC controller 3 selects a sequence C in Step S24 and outputs a start command signal to the engine controller 4 to finish the routine. The engine controller 4 having received the input, of the start command signal starts the internal combustion engine 5 in accordance with the sequence C.

The sequence C is a sequence for selecting the start conditions such as the throttle opening, the fuel injection amount and the ignition timing on the premise that the valve timing is set at the most retarded timing. Even if the internal combustion engine 5 is started in a state where the valve timing is set at the most retarded timing, the deterioration of starting performance and exhaust emission can be minimized by these settings.

The result of the above controls is described with reference to FIG. 4.

Figure 4:
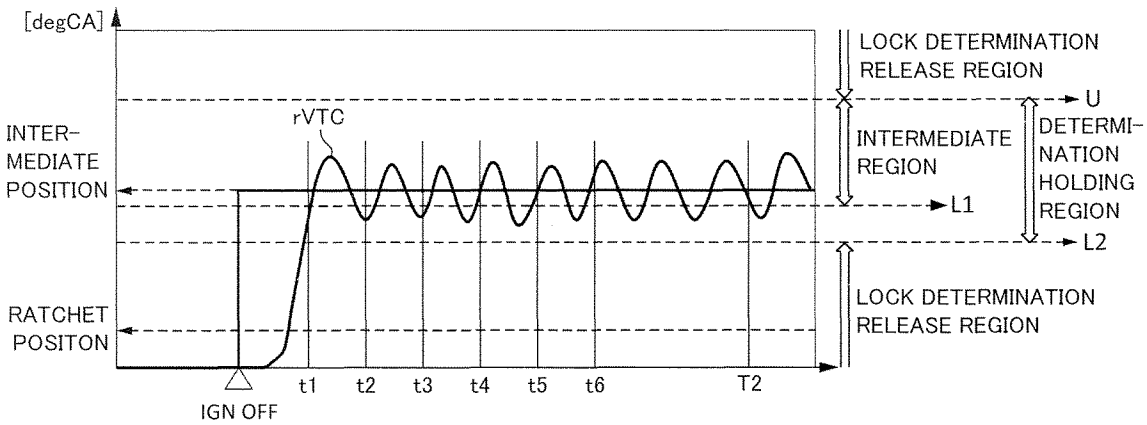
FIG. 4 is a timing chart showing an execution result of the lock determination routine.

In FIG. 4, IGN OFF means the switching of the ignition switch from ON to OFF. Associated with this, the VTC controller 3 starts the execution of the lock determination routine of FIG. 2. Before the switching of the ignition switch from ON to OFF, the internal combustion engine 5 is operated in a state where the valve timing is held at the most retarded timing by the variable valve timing mechanism 1.

When the ignition switch is switched to OFF, the intermediate locking request is normally issued and the determination of Step S1 becomes affirmative. Further, the variable valve timing mechanism 1 operates to change the valve timing from the most retarded timing to the intermediate timing.

If the determination of Step S1 is affirmative, the VTC controller 3 performs the processings of Step S2 and subsequent steps. Since the actual VTC conversion angle rVTC detected by the actual VTC conversion angle sensor 2 is below the first lower limit value L1 at first, the determination of Step S4 is negative. Then, the processings of Steps S1 to S4 and S12 are repeated without starting the second timer Timer2.

When the actual VTC conversion angle rVTC reaches the first lower limit value L1 at time t1, the determination of Step S4 becomes affirmative, the intermediate locking flag fM is set to 1 in Step S5 and the value of the second timer Timer2 is reset in Step S6. As a result, in the next and subsequent executions of the routine, the determination of Step S3 becomes negative and the processings of Step S7 and subsequent steps are performed.

At time t2, the actual VTC conversion angle rVTC is below the first lower limit value L1, but above the second lower limit value L2. That is, the actual VTC conversion angle rVTC is still in the determination holding region even if departing from the intermediate region. In this case, the determination of Step S8 becomes affirmative, whereby the increment of the value of the second timer Timer2 is continued.

If the value of the second timer Timer2 indicating the time during which the actual VTC conversion angle rVTC is in the determination holding region exceeds the predetermined value T2, the VTC controller 3 determines that the intermediate locking has been completed. In this case, the VTC controller 3 sets both the intermediate locking request flag fMA and the intermediate locking completion flag fMB to 1 in Step S11. As a result, when the internal combustion engine 5 is started next, the sequence A is applied in the engine start sequence determination routine of FIG. 3.

As described above, this embodiment provides the lock determination device for the variable valve timing mechanism 1 having a function of locking the valve timing of the internal combustion engine 5 in the intermediate position between the most retarded position where the valve timing is most retarded and the most advanced position where the valve timing is most advanced in stopping the operation of the internal combustion engine 5. The lock determination device includes the actual VTC conversion angle sensor 2 and the VTC controller 3.

The actual VTC conversion angle sensor 2 detects the operating position of the variable valve timing mechanism 1. The VTC controller 3 starts the timer when the operating position of the variable valve timing mechanism 1 enters the intermediate region in Step S6 of the lock determination routine. The VTC controller 3 determines in Step S8 of this routine whether or not the operating position of the variable valve timing mechanism 1 is in the determination holding region wider on the retardation side than the intermediate region after the timer is started. The VTC controller 3 increments the value of the timer in Step S9 of this routine if the operating position of the variable valve timing mechanism 1 is in the determination holding region. The VTC controller 3 determines in Step S11 of this routine that the operating position of the variable valve timing mechanism 1 has been locked in the intermediate position if the value of the time reaches the predetermined value.

Accordingly, the value of the timer is incremented as long as the operating position of the variable valve timing mechanism 1 is in the determination holding region wider on the retardation side than the intermediate region. By this algorithm, it is possible to precisely and quickly determine the completion of the locking of the operating position of the variable valve timing mechanism 1 in the intermediate position by preventing an erroneous determination on the basis of an error of the hardware of the variable valve timing mechanism 1.

In this embodiment, the VTC controller 3 further stops the operation of the internal combustion engine 5 in Step S16 of the lock determination routine if the operating position of the variable valve timing mechanism 1 is determined to be locked in the intermediate position.

Thus, the internal combustion engine 5 can be stopped after the locking of the operating position of the variable valve timing mechanism 1 in the intermediate position is confirmed, and starting performance and exhaust emission at the time of restart can be improved.

The difference between the determination holding region and the intermediate region is set on the basis of the error of the hardware relating to the locking function of the variable valve timing mechanism 1. Thus, the completion of the intermediate locking can be determined early without depending on dimensional variations of the key and the key groove.

In this embodiment, the VTC controller 3 further stops the operation of the internal combustion engine 5 in Step S16 of the lock determination routine if it is not determined that the operating position of the variable valve timing mechanism 1 has been locked in the intermediate position within the predetermined time after the operation stop command for the internal combustion engine 5.

By specifying the time up to the stop of the operation of the internal combustion engine 5 in this way, a time for waiting for the completion of the intermediate locking can be limited and the deterioration of fuel economy of the internal combustion engine 5 can be prevented.

In this embodiment, the VTC controller 3 further drives the variable valve timing mechanism 1 and changes the operating position of the variable valve timing mechanism 1 to the intermediate position during the restart of the internal combustion engine 5 in Step S23 of the engine start sequence determination routine if the operation of the internal combustion engine 5 is stopped without determining that the variable valve timing mechanism 1 has been locked in the intermediate position within the predetermined time from the operation stop command for the internal combustion engine 5.

This can control the variable valve timing mechanism 1 to the intermediate timing in a shortest time from start during the restart of the internal combustion engine 5 and suppress the deterioration of exhaust emission to a minimum level.

Although the embodiment of the present invention has been described above, the above embodiment is merely an illustration of one application example of the present invention and not of the nature to limit the technical scope of the present invention to the specific configuration of the above embodiment.

The present application claims priority of Japanese Patent Application No. 2013-117786 filed with the Japan Patent Office on Jun. 4, 2013, all the contents of which are hereby incorporated into this specification by reference.

What is claimed is:

1. A lock determination device for a variable valve timing mechanism, having a function of locking a valve timing of an internal combustion engine in an intermediate position between a most retarded position where the valve timing is most retarded and a most advanced position where the valve timing is most advanced, when the internal combustion engine stops operation, the device comprising:

an actual VTC conversion angle sensor that detects an operating position of the variable valve timing mechanism; and a VTC controller comprising a microcomputer including a central processing unit, a read-only memory, a random access memory, and an input/output interface, the VTC controller programmed to:

start to count a timer value when the operating position of the variable valve timing mechanism enters an intermediate region, the intermediate region being a predetermined region including the intermediate position;

determine whether or not the operating position of the variable valve timing mechanism is in a determination holding region which covers the intermediate region and is wider on a retardation side than the intermediate region after the timer is started;

increment the timer value if the operating position of the variable valve timing mechanism is in the determination holding region; and determine that the operating position of the variable valve timing mechanism has been locked in the intermediate position when the timer value reaches a predetermined value.

2. The lock determination device according to claim 1, wherein the VTC controller is further programmed to:

stop the operation of the internal combustion engine if the operating position of the variable valve timing mechanism has been determined to be locked in the intermediate position.

3. The lock determination device according to claim 1, wherein:

a difference between the determination holding region and the intermediate region is set on the basis of an error of hardware relating to the function, the function being a locking function of the variable valve timing mechanism.

4. The lock determination device according to claim 1, wherein the VTC controller is further programmed to:

stop the operation of the internal combustion engine if the operating position of the variable valve timing mechanism has not been determined to be locked in the intermediate position within a predetermined time from an operation stop command for the internal combustion engine.

5. The lock determination device according to claim 4, wherein the VTC controller is further programmed to:

change the operating position of the variable valve timing mechanism to the intermediate position by driving the variable valve timing mechanism during a restart of the internal combustion engine if the operation of the internal combustion engine is stopped without determining that the operating position of the variable valve timing mechanism has been locked in the intermediate position within the predetermined time from the operation stop command for the internal combustion engine.

6. A lock determination method for variable valve timing mechanism having a function of locking a valve timing of an internal combustion engine in an intermediate position between a most retarded position where the valve timing is most retarded and a most advanced position where the valve timing is most advanced, when the internal combustion engine stops operation, comprising:

starting to count a timer value when the operating position of the variable valve timing mechanism enters an intermediate region, the intermediate region being a predetermined region including the intermediate position;

determining whether or not the operating position of the variable valve timing mechanism is in a determination holding region which covers the intermediate region and is wider on a retardation side than the intermediate region after the timer is started;

incrementing the timer value if the operating position of the variable valve timing mechanism is in the determination holding region; and determining that the operating position of the variable valve timing mechanism has been locked in the intermediate position when the timer value reaches a predetermined value.

* * * * *